US005954432A

United States Patent [19]

Laudenberg

[11] Patent Number: 5,954,432

[45] Date of Patent: Sep. 21, 1999

[54] DOUBLE POUCH PACKAGE

[75] Inventor: Bernd Laudenberg, Wipperfurth, Germany

[73] Assignee: Profile Packaging, Inc., Sarasota, Fla.

[21] Appl. No.: 08/970,336

[22] Filed: Nov. 14, 1997

Related U.S. Application Data

[60] Provisional application No. 60/030,952, Nov. 18, 1996.

[51] Int. Cl.[6] ..... B65D 30/10; B65D 33/08

[52] U.S. Cl. ..... 383/38; 383/10; 383/37

[58] Field of Search ..... 383/9, 10, 37, 383/38

[56] References Cited

U.S. PATENT DOCUMENTS 5,100,000 3/1992 Huseman ..... 383/37 X

FOREIGN PATENT DOCUMENTS 1498629 10/1967 France ..... 383/10
2752489 5/1979 Germany ..... 383/9
3805054 8/1989 Germany ..... 383/38

*Primary Examiner*—Jes F. Pascua
*Attorney, Agent, or Firm*—Gifford, Krass, Groh, Sprinkle, Anderson & Citkowski, P.C.

[57] ABSTRACT

A double pouch package and method of making it in which a pair of stand-up pouches, each with a supporting base and front and rear panels extending from opposite sides of the base are closed at their upper ends to form a flat band in each pouch. The rear panels of a pair of pouches are positioned adjacent to each other and the front panels have portions at the upper edges of the bands which are fused together to form a unitary double pouch package. Holes are formed in the upper band for receiving support members for transporting the pouches during manufacture or for displaying the filled pouches at the market place. Also, the holes can form part of a handle for carrying the double pouch package.

6 Claims, 3 Drawing Sheets

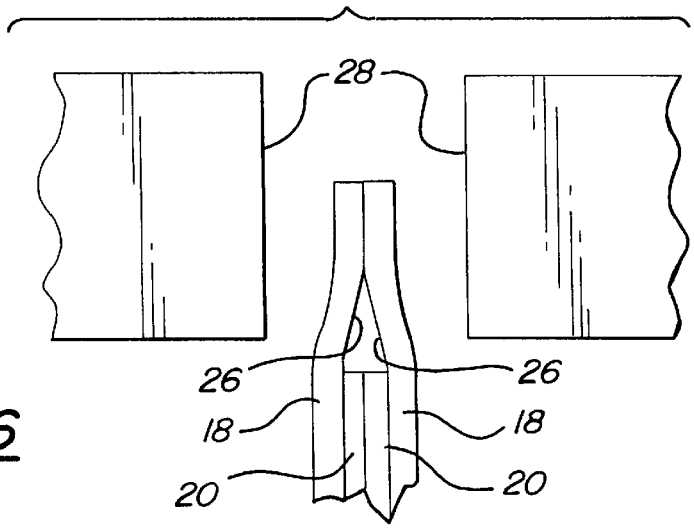
FIG-6
FIG-7
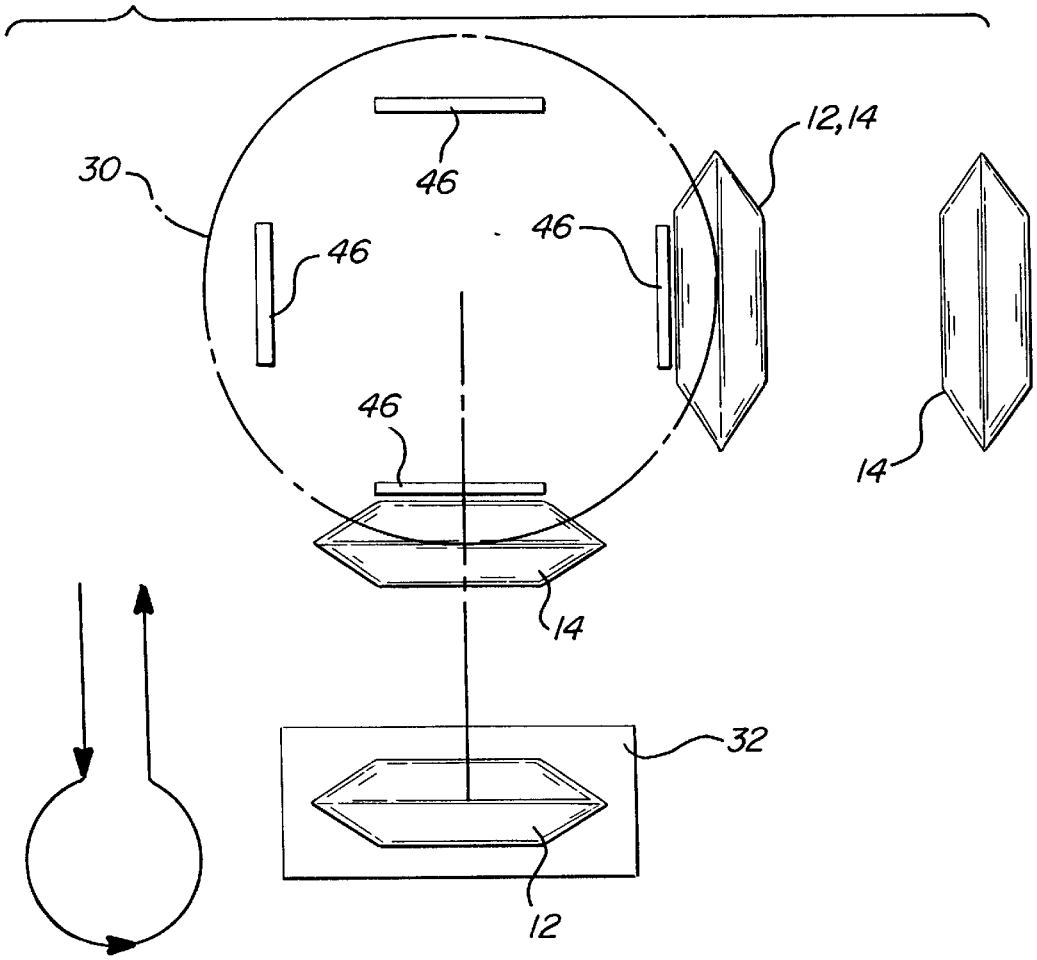

| | | | | | | | |
|---|---|---|---|---|---|---|---|
| FP | FP | FP | FP | FP | FP | FP | |
| RP | RP | RP | RP | RP. | RP | RP | |

| | | | | | | | |
|---|---|---|---|---|---|---|---|
| FP | RP | FP | RP | FP | RP | FR | |
| RP | FP | RP | FP | RP | FP | RP | |

DOUBLE POUCH PACKAGE

This application claims the benefit of U.S. Provisional application No. 60/030,952 filed Nov. 18, 1996.

This invention relates to flexible packages and more particularly to pouch-type packages.

A large variety of products are marketed in flexible plastic bags which are referred to as flat bags because in their empty stage they are in a flat condition. Such flat bags range from flat pouches having four peripheral edges sealed to stand up type of pouches which are recloseable. Such pouches are used for a variety of products such as liquids, pastes, powder, grains, seeds and a variety of other products.

There is a special need for double pouch packages which are filled and marketed as a unit and contain not one but two complementary products. For example, in the case of coffee there might be a desire to market both regular and decaffeinated coffee or flavored coffees. In the case of liquids such as wine, there might be a desire to market both red and white wines in the same package. Even in the case of a single product, there is an advantage to the consumer in that one of the two pouches of the double pouch package may be opened and used leaving the other pouch in its originally sealed condition.

It is an object of the invention to provide a double pouch-type package in which two pouches are formed as a unit to be handled as a unit from the time it is packed with a product and sealed until the time it is received and used by the consumer.

In one version of the invention, it is an object to provide a dual pouch package in which a handle is formed to form a hand hold by which the package can be carried and moved.

DESCRIPTION OF THE DRAWINGS

FIG. 6 is a diagrammatic view showing the relationship of the heat sealing structure relative to the open end of a pair of pouches;

FIG. 7 is a diagrammatic view of a portion of the machinery used to properly position pouches for joining them together;

DETAILED DESCRIPTION

Figure 1:
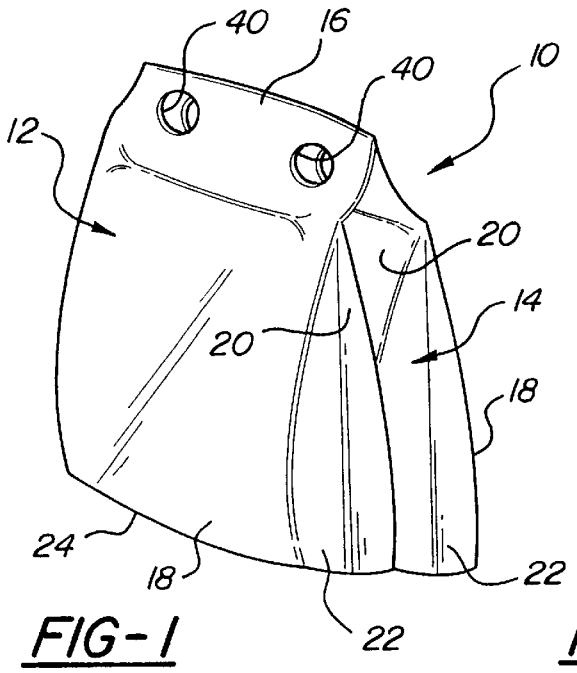
FIG. 1 is a perspective view of a double pouch package embodying the invention.

Referring to the drawings, and particularly to FIG. 1 the double pouch package embodying the invention is designated generally at 10 and comprises pouches 12 and 14 joined together at their top by a common support member 16. Each of the pouches 12 and 14 is made up of a front panel 18 and a back panel 20 joined together by folding gusset ends 22. Panels 18, 20 and ends 22 merge with a relatively flat bottom or base portion 24. When the pouches are filled with product, the relatively flat bottom portion 24 allows the package 10 to stand in a vertical position.

The pouches 12 and 14 are produced in the normal fashion, with some exceptions, on a horizontal flat bag machine which, by way of example, can be of a type manufactured by Laudenberg Machinery, Inc., generally designated as Model FBM-20. Such machines can be used for manufacturing a large variety of relatively flat pouches.

Figure 4:
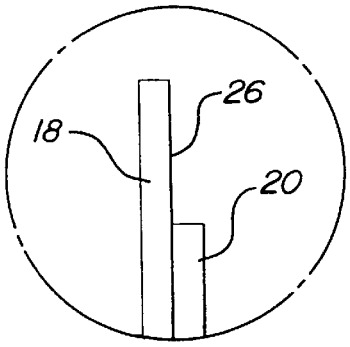
FIG. 4 is an enlarged portion of FIG. 3.

In the present instance, the pouches are produced in such a manner that the upper seating band which closes the pouches is wider than the corresponding portion of a single pouch. Also, the front panel 18 and back panel 20 are misaligned or off-set as indicated in FIG. 4 so that the front panel 18 extends above the back panel 20. The exposed area 26 on each of the pouches affords a sealant surface. Such sealant surface is afforded by the plastic surface of the material used to form the pouches so that when heat is applied, the contacting surfaces are melted and upon cooling are fused to form a seal or bond.

Figure 5:
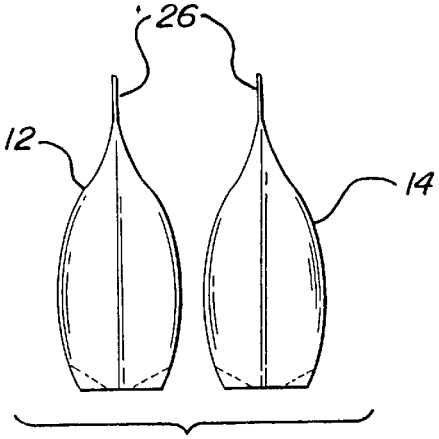
FIG. 5 is a end elevation of a pair of pouches in adjacent relationship to each other.

When the pouches 12 and 14 are positioned relative to each other as seen in FIG. 5 with back panels 20 facing each other, the sealant areas 26 can be brought into contact with each other as shown in FIG. 6 and heating devices indicated at 28 can be brought into contact at opposite sides of the support member 16 to apply heat and pressure so that upon cooling the pouches 12 and 14 are attached to each other.

Figures 8, 9, 10:
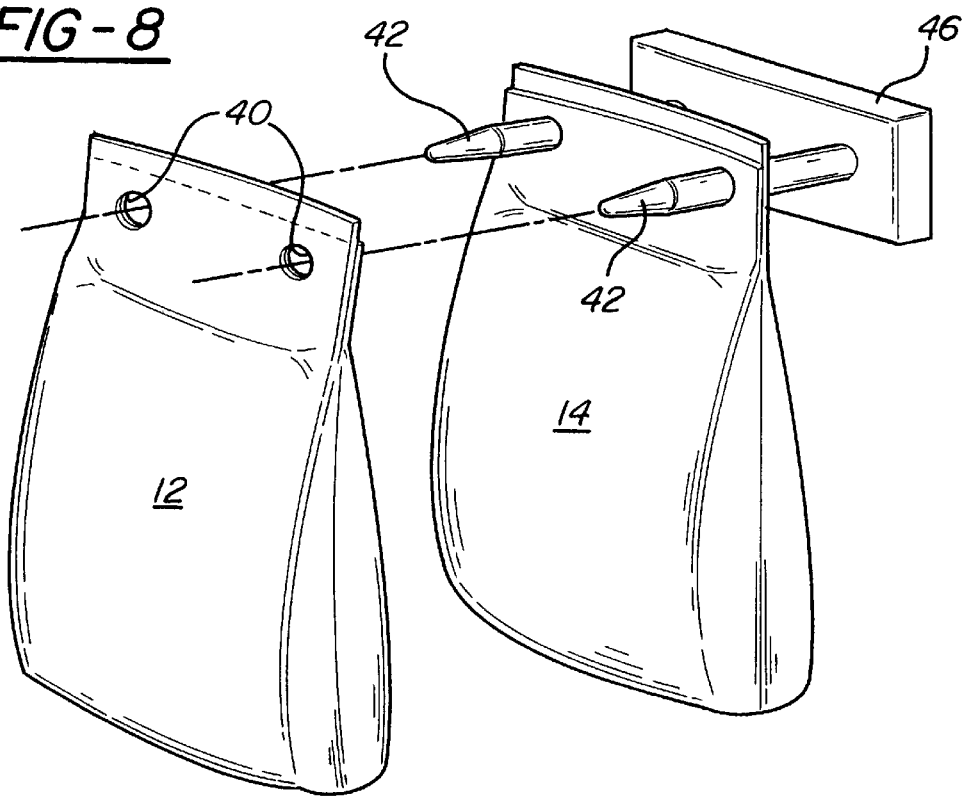
FIG. 8 is a view of a pair of pouches prior to positioning them in adjacent relationship to each other for joining them into a single package.
FIG. 9 is a diagrammatic view of one printing arrangement of panels used in the formation of one of the pouches.
FIG. 10 is a view similar to FIG. 9 showing a different printing arrangement of panels for another version of a double pouch package.

After the pouches 12 and 14 are produced on the flat bag machine, the filled and sealed pouches or bags are transferred from the main machine to a secondary unit of a chain or turret type. In FIG. 7, such a secondary unit is designated as a turret 30. After the turret 30 receives a first filled and sealed pouch 12 at a station in the 3 o'clock position, the turret 30 is indexed simultaneously with the indexing of the primary machine so that the first pouch 12 is moved to the next station at the 6 o'clock position. Thereafter, a second pouch 14 is transferred to the station at the 3 o'clock position of the turret 30 and simultaneously the first pouch 12 is removed from the 6 o'clock position and transferred to auxiliary machine 32. At auxiliary machine 32, the first pouch 12 is rotated 180°. Thereafter, the second pouch 14 is indexed from the 3 o'clock position to the 6 o'clock position on the turret 30. In that condition, the first pouch 12 is replaced on the turret 30 and positioned adjacent to pouch 14 as illustrated in FIG. 8. This places the exposed sealant surfaces 26 of the pouches 12 and 14 in facing relationship to each other, as seen in FIG. 5. In this manner, alternate pouches 12 are removed and rotated to place them in facing relationship with the next adjacent pouch 14. Heating means, such as shown at 28 in FIG. 6, can be brought into contact with opposite sides of the pouches at the 9 o'clock position of turret 30 and the completed filled package 10 can be removed at the 12 o'clock position for transport to a storage or shipping area.

To facilitate alignment of pouches 12 and 14 with each other, the pouches are formed with a pair of guide holes 40 as seen in FIG. 8. The insertion of a pair of laterally spaced guide pins 42 into the guide holes 40 serves not only to align pouches 12 and 14 relative to each other but also acts as the conveying means by which the pouches are transported to the various stations on the turret 30. Such guide pins 42 are mounted on a base member 46, one of which is fixed at each of the four stations on the turret 30.

Each of the pouches 12 and 14 incorporates a front panel 18 and rear panel 20. Typically, the front panel 18 is an attractive promotional display or label and the rear panel may have information relative to use of the product. In some cases, it may be desired that the front panel be at the outside panels of the double pouch assembly 10. As an alternative, it may be desirable to have the front panels of the pouches 12 and 14 facing in the same direction, that is, with one panel exposed to the outside of the double pouch package 10 and the other panel facing the rear panel of the first pouch. The printing process can be varied to accommodate each of these arrangements. The printing arrangement shown in FIG. 9 is used if the front panels are to be exposed to the opposite sides of the double pouch package 10, and the arrangement shown in FIG. 10 is used if the panels are to face in the same direction.

Various aspects of the double pouch package 10 and the machines by which the double pouch package is produced have been disclosed. The method by which the double pouch package 10 is produced can be described as comprising the steps of forming open pouches 12 and 14 in adjacent relationship to each other such that each of the pouches has a wide upper band forming exposed sealing surfaces 26 in which guide holes 40 are formed. The bags are formed in an opened condition so that products can be introduced through the open top after which the upper bands are sealed. Thereafter, alternate pouches can be removed from the path of movement and rotated 180°. Such pouches can be returned to the path of movement to bring sealing surfaces of two pouches 12 and 14 into facing relation to each other. Subsequently, the facing sealing surfaces are fused together to result in a double pouch package 10.

Figure 2:
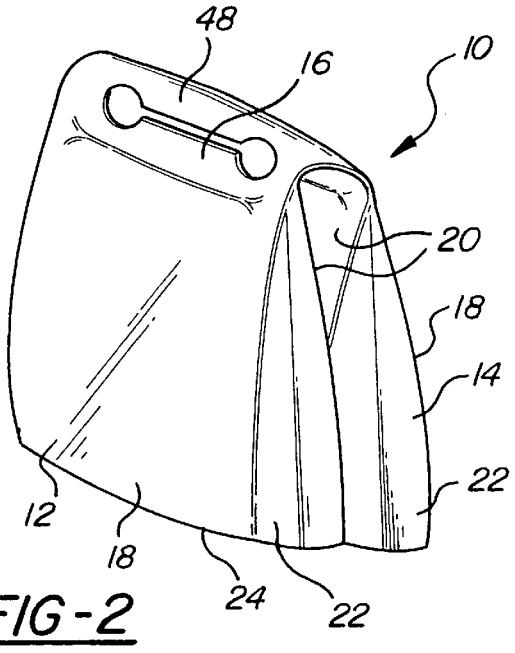
FIG. 2 is a perspective view similar to FIG. 1 of another embodiment of the invention.
Figure 3:
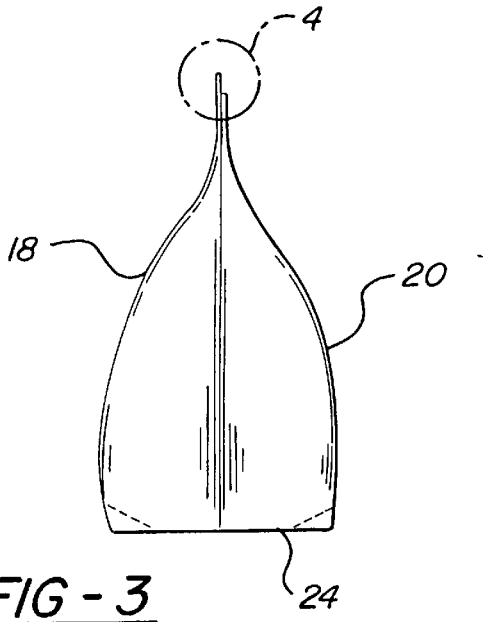
FIG. 3 is a side elevation of a single pouch used in forming the double pouch of FIGS. 1 and 2.

To form a handle 48, as shown in FIG. 2, a slit can be formed between adjacent peg holes 40. The result is a carrying handle by which the dual pack package 10 can be transported by hand.

I claim:

1. A double pouch package comprising:

a first pouch and a second pouch, each of said pouches having a supporting base portion with front and rear panels extending from opposite sides of said base portion and meeting at their upper ends to form a closed opening to the associated one of said pouches, said first and second pouches being disposed with said rear panels in adjacent relation to each other and having said upper ends of said front panels of both of said pouches having an upper portion extending beyond an upper edge of said rear panel, said upper portion of each of said front panels having a rear side fixed to each other to form a unitary package, said front and rear panels having an upper band formed below said upper edge of said rear panel, said upper band having at least one aperture passing through said front and rear panels of both pouches to permit said pouch package to be suspended or carried.

2. The package of claim 1 wherein spaced apertures are formed in said upper band for receiving peg members to support said package.

3. The package of claim 2 wherein a slit is formed between said apertures to form a handle.

4. The package of claim 1 wherein an elongated aperture is formed in said upper band to form a handle.

5. The package of claim 1 wherein said rear surfaces of said front panels form sealant surfaces fused together upon the application of heat and pressure.

6. The package of claim 1 wherein said first and second pouches are filled with a product before being fixed to each other.

* * * * *